United States Patent [19]

Nakanishi

[11] Patent Number: 4,916,839

[45] Date of Patent: Apr. 17, 1990

[54] PAGE TURNING APPARATUS

[75] Inventor: Akira Nakanishi, Tokyo, Japan

[73] Assignee: Sony Corporation, Tokyo, Japan

[21] Appl. No.: 210,760

[22] Filed: Jun. 23, 1988

[30] Foreign Application Priority Data

Jun. 29, 1987 [JP] Japan ..... 62-161947

[51] Int. Cl.[4] ..... G09F 11/02

[52] U.S. Cl. ..... 40/475; 40/531

[58] Field of Search ..... 40/531, 476, 475; 84/487, 502, 517; 355/25, 76

[56] References Cited

U.S. PATENT DOCUMENTS

| | | | |
|---|---|---|---|
| 2,151,228 | 3/1939 | Pflanze | 271/1 |
| 2,584,730 | 2/1952 | Novick | 271/150 |
| 3,149,835 | 9/1964 | Branscome | 271/150 |
| 3,442,505 | 5/1969 | Szentkuti | 271/1 |
| 3,550,296 | 12/1970 | Castagna | 40/531 |
| 3,586,318 | 6/1971 | Reckdahl et al. | 271/42 |
| 3,588,087 | 6/1971 | Revin et al. | 270/58 |
| 3,728,645 | 6/1973 | Gray et al. | 271/97 |
| 3,880,453 | 4/1974 | Kroes | 285/161 |
| 3,910,567 | 10/1975 | Songer | 271/42 |
| 3,939,587 | 2/1976 | Weststrom | 40/531 |
| 3,976,291 | 8/1976 | Bernardi et al. | 271/94 |
| 3,981,495 | 9/1976 | Bijttebier | 271/18.3 |
| 4,043,484 | 8/1977 | Vanjo | 221/213 |
| 4,102,071 | 7/1978 | D'Arcy | 40/531 |
| 4,121,361 | 10/1978 | D'Arcy | 40/470 |
| 4,157,823 | 6/1979 | Morton | 271/10 |
| 4,160,334 | 7/1979 | Willis | 40/531 |
| 4,506,876 | 3/1985 | Nishibori | 271/104 |
| 4,544,149 | 10/1985 | Graef et al. | 271/107 |
| 4,545,141 | 10/1985 | Ito et al. | 40/531 |
| 4,591,140 | 5/1986 | Illig et al. | 271/11 |
| 4,673,286 | 6/1987 | Shinbrot | 355/25 |
| 4,688,781 | 8/1987 | Blessing | 271/1 |
| 4,693,594 | 9/1987 | Garavuso et al. | 355/25 |
| 4,719,712 | 1/1988 | Moreau et al. | 40/531 |

FOREIGN PATENT DOCUMENTS

| | | | |
|---|---|---|---|
| 348830 | 5/1931 | United Kingdom | 40/531 |

*Primary Examiner*—Cary E. Stone

*Attorney, Agent, or Firm*—Philip M. Shaw, Jr.

[57] ABSTRACT

The uppermost page of an opened volume is rubbed toward the volume's spine to buckle the uppermost page and permit air to enter a space between the buckled page and the next page. The buckled page is then released to fall back toward its initial position and form an air layer between the uppermost page and the next page. The uppermost page is attracted upward by applying a suction force and a plate is moved along a path crossing the attracted uppermost page to turn it.

16 Claims, 17 Drawing Sheets

4
5
7d
8
13
13a
12
14
1

PAGE TURNING APPARATUS

BACKGROUND OF THE INVENTION

This invention relates to a method and apparatus for turning book or magazine pages placed on a document table.

In order to record information obtained from books or magazines on microfilms or other recording media, it is required to turn the book or magazine pages placed on a document table. It has been proposed to relieve the monotonous work by employing an automatic page turning apparatus. The conventional page turning apparatus employs a pressure differential to attract book or magazine pages. Although this type of automatic page turning apparatus has been widely accepted because of its capacity for producing a great attraction force, one serious difficulty occurs in that the pressure differential has an effect on the next page through a number of fine holes formed in the page to be turned so as to attract two or more pages at a time. For this reason, troublesome adjustments are required to obtain the proper attraction force necessary to turn only one page at a time. Another type of automatic page turning apparatus employs an electrostatic attraction force produced between an electrode and the book or document page to be turned to attract the page onto the electrode. However, such a conventional page turning apparatus sometimes fails to produce a sufficient attraction force particularly when the apparatus is used in an atmosphere having a high humidity.

Attempts have been made to overcome the difficulties associated with such conventional page turning apparatus. For example, Japanese Patent Kokai No. 57-102398 discloses an improved page turning apparatus which includes a suction pipe connected to an electric fan for producing a pressure differential used in attracting a book or document page. A strength gage, which is sensitive to the weight of the suction pipe, is used to determine whether one or more pages are attracted at a time. If the suction pipe attracts two or more pages, the attraction force is reduced by controlling the electric fan. Since the attraction force required to attract one page is different from one kind of paper to another, however, it is very difficult to produce an appropriate attraction force permitting only one book or document page to be attracted for various kinds of document paper. In addition, since the margin between an attraction force level required to attract one book or document page and the attraction force level required to attract two book or document pages is very small, the extent to which the attraction force can be increased is very small. Accordingly, it is very difficult to ensure reliable page turning operation.

SUMMARY OF THE INVENTION

It is a main object of the invention to provide an improved page turning method and apparatus which can perform page turning operations in a reliable manner unaffected by the kind of paper of the book or document pages to be turned.

There is provided, in accordance with the invention, a method of turning book or magazine pages placed face up on a document table. The method comprises the steps of rubbing the uppermost one of the pages under a friction force in a direction buckling the uppermost page so as to permit air to enter a space between the buckled page and the next page, releasing the uppermost page to permit the upper most page to return toward its initial position due to its rigidity so as to form an air layer between the uppermost page and the next page, attracting the uppermost page upward, and moving a plate along a path crossing the attracted uppermost page to turn the uppermost page.

In another aspect of the invention, there is provided an apparatus for turning book or magazine pages placed face up on a document table. The apparatus comprises a first means including a friction member for rubbing the uppermost one of the pages in a direction buckling the uppermost page so as to permit air to enter a space between the buckled page and the next page, a second means for releasing the friction member from the uppermost page to permit the uppermost page to return to its initial condition due to its rigidity so as to form an air layer between the uppermost page and the next page, a third means for generating a negative pressure to attract the uppermost page upward, a fourth means including a plate movable along a travelling path crossing the attracted page to turn the uppermost page, and a control unit for operating the first, second, third and fourth means in this sequence.

BRIEF DESCRIPTION OF THE DRAWINGS

The invention will be described in greater detail by reference to the following description taken in connection with the accompanying drawings, in which like reference numerals identify like elements in the several figures and in which.

DETAILED DESCRIPTION OF THE INVENTION

Figure 1:
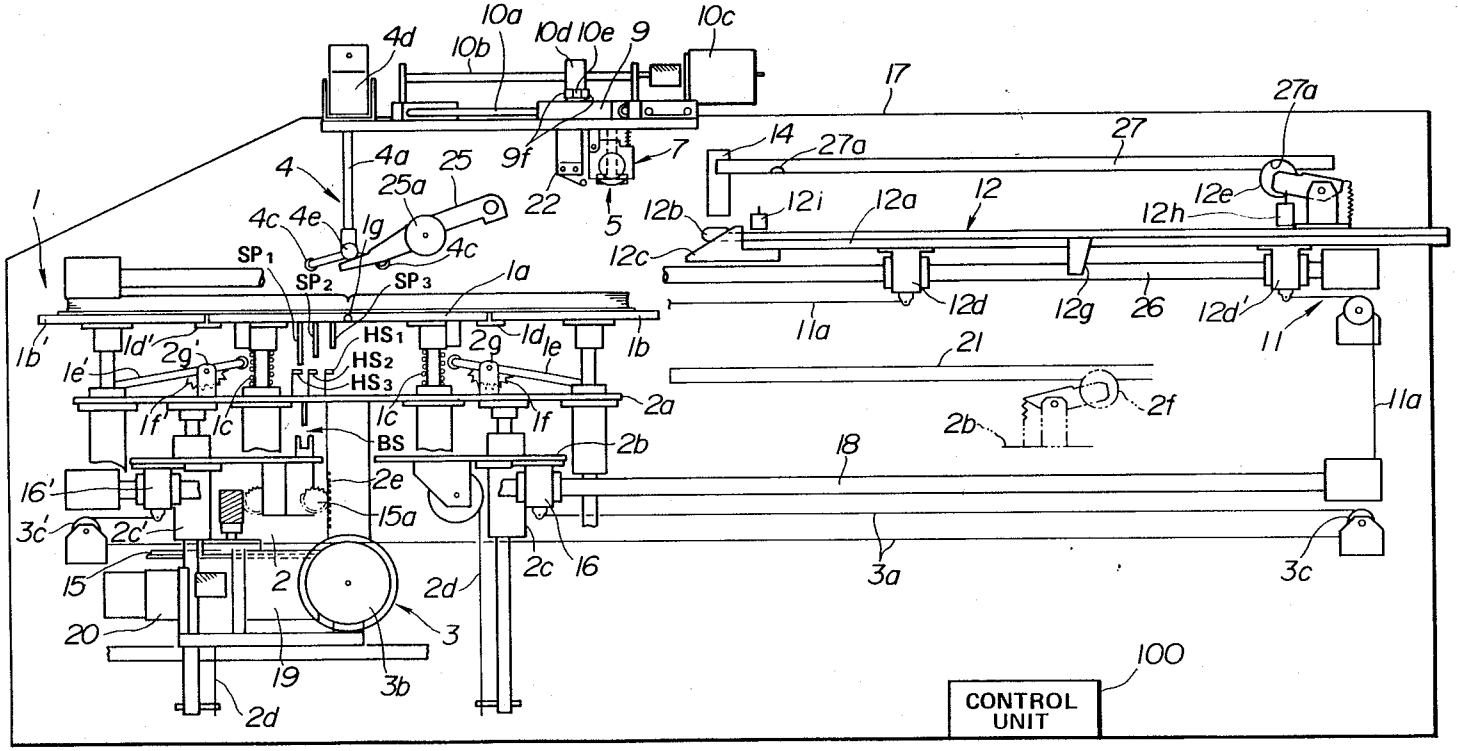
FIG. 1 is a side view showing the whole arrangement of the page turning apparatus embodying the invention.
Figure 2:
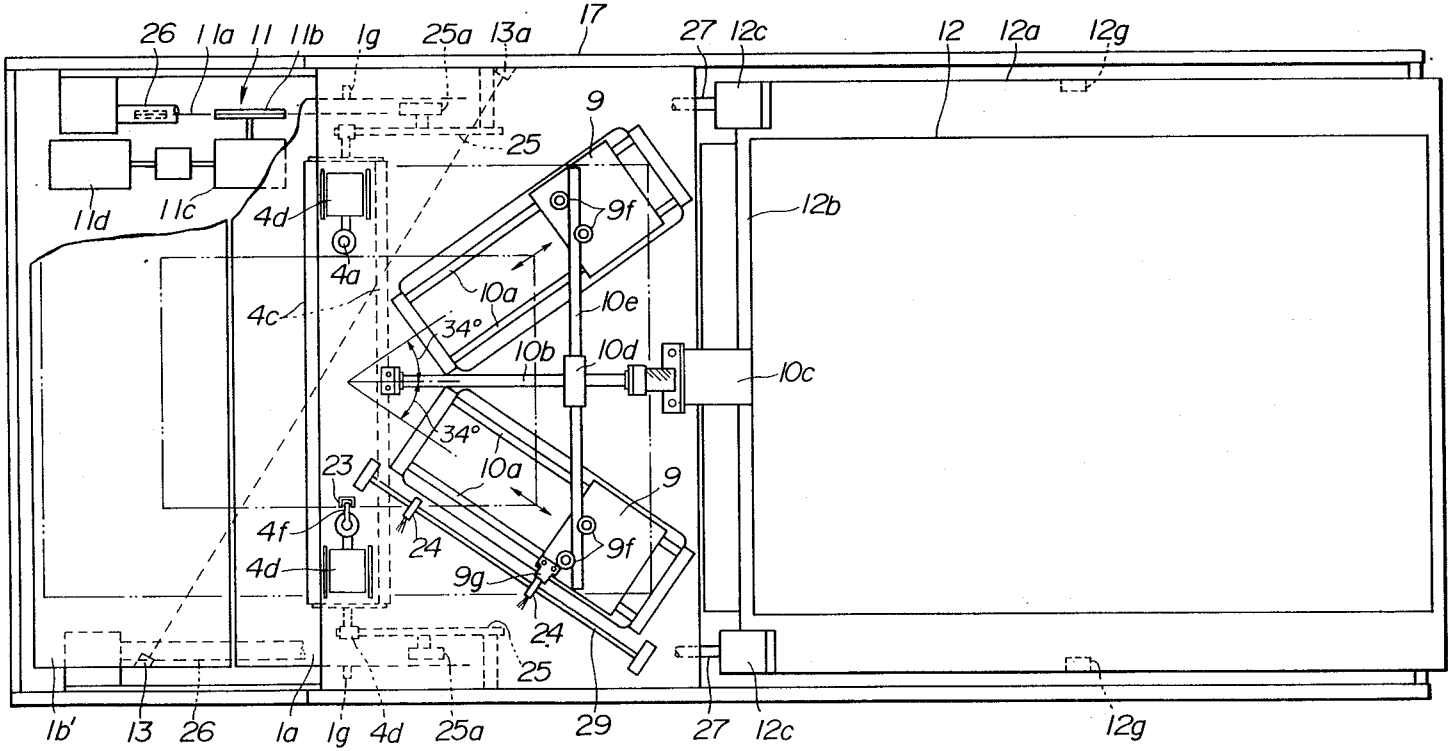
FIG. 2 is a plan view of the page turning apparatus.

With reference to the drawings, wherein like numerals refer to like parts in the several views, and in particular to FIGS. 1 and 2, there is illustrated an automatic page turning apparatus embodying the invention. The automatic page turning apparatus shown is applied to an image scanner. The particular application is only for illustrative purposes and the apparatus of the invention can be used for a variety of applications where page turning is essential.

The automatic page turning apparatus includes a document table 1. A book or magazine from which information is read is placed face up on the document table 1. The document table 1 is divided into a center table 1*a* and two side tables 1*b* and 1*b'* located on the opposite sides of the center table 1*a*. The center table 1*a* is supported through sliders on an elevating table 2*a* for upward and downward movement with respect to the elevating table 2*a*. Springs 1*c* are provided between the center table la and the elevating table 2*a* to urge the center table 1*a* upward or away from the elevating table 2*a*. Each of the side tables 1*b* and 1*b'* is supported through sliders on the elevating table 2*a* for upward and downward movement with respect to the elevating table 2*a*. A stopper 1*d* is secured on the bottom surface of the center table la and it extends outward from one side edge of the enter table 1*a*. The stopper 1*d* comes into engagement with the side table 1*b* so as to hold the center table 1*a* at the same level as the side table 1*b* when the side table 1*d* moves downward with respect to the center table 1*a*. Similarly, a stopper 1*d'* is secured on the bottom surface of the center table 1*a* and it extends outward from the other side edge of the center table 1*a*. The stopper 1*d'* comes into engagement with the side table 1*b'* so as to hold the center table 1*a* at the same level as the side table 1*b'* when the side table 1*d'* moves downward with respect to the center table 1*a*. A flexible lever le is pivoted on a support 2*g* secured on the elevating table 2*a*. The flexible lever 1*e* is held straight by a spring 1*f*. When the center table 1*a* moves downward into abutment with one end of the flexible lever 1*e*, the flexible lever 1*e* rotates to push the side table 1*b* upward at the other end thereof. A flexible lever 1*e'* is pivoted on a support 2*g'* secured on the elevating table 2*a*. The flexible lever 1*e'* is held straight by a spring 1*f'*. When the center table 1*a* moves downward into abutment with one end of the flexible lever 1*e'*, the flexible lever 1*e'* rotates to push the side table 1*b'* upward at the other end thereof. The distance between the center table 1*a* and the elevating table 2*a* is detected by distance sensor units including photo sensors HS1, HS2 and HS3 secured on the elevating table 2*a*. The photo sensors HS1, HS2 and HS3 are associated with sensor plates SP1, SP2 and SP3 extending from the bottom surface HS1, HS2 and HS3, respectively. The sensor plates SP1, SP2 and SP3 have progressively different lengths, beginning with the longest length and becoming shorter going from left to right in FIG. 1.

The elevating table 2*a* is supported through sliders 2*c* and 2*c'* on a carrying table 2*b* for upward and downward movement with respect to it. Constant force springs 2*d* are provided to urge the elevating table 2*a* upward or toward the document table 1. The carrying table 2*b* has a drive motor 15 secured thereon. A pinion gear 15*a*, driven by the motor 15, is in mesh engagement with a rack 2*e* extending through the carrying table 2*b* downward from the bottom surface of the elevating table 2*a* for moving the elevating table 2*a* toward and away from the document table 1. A bottom sensor BS is provided on the carrying table 2*b* for detecting the lower limit position of the elevating table 2*a*. The carrying table 2*b* is supported at its four corners through sliders 16 and 16' on horizontal guide shafts 18 for sliding movement on the guide shafts 18. The guide shafts 18 are supported by the side plates of a housing 17.

A sliding mechanism, designated generally by the numeral 3, includes a drive wire 3*a* fixed at one end to the slider 16 and at the other end thereof to the slider 16'. The drive wire 3*a* is journalled around a pulley 3*c* secured on the housing 17 near its left end. The drive wire 3*a* is wrapped about a drive pulley 3*b* which is driven through a clutch 19 by means of a gear motor 20 mounted on the carrying table 2*b*. The sliding mechanism 3 also includes a guide bar 21 formed in its bottom surface with right and left recesses. A positioning roller 2*f* is secured on the carrying table 2*b* and urged into pressure contact with the bottom surface of the guide bar 21. The positioning roller 2*f* comes into engagement with the right recess when the carrying table 2*b* reaches its right most position. This condition is detected by a right end sensor (not shown). The positioning roller 2*f* comes into engagement with the left recess when the carrying table 2*b* reaches its left most position. This condition is detected by a left end sensor (not shown).

A glass plate 12 is retained on a frame 12*a* having a round front end surface 12*b*. The frame 12*a* has tapered guide members 12*c* secured on the opposite sides of the front end of the frame 12*a*. The frame 12*a* has two pair of sliders 12*d* and 12*d'* secured on the four corners of the bottom surface of the frame 12*a*. A wire 11*a* is secured at one end to one of the sliders in each pair and at the other end thereof to the other slider. The wire 11*a* is wrapped about a drive pulley 11*b* which is driven through a clutch 11*c* by means of a gear motor 11*d* (FIG. 2). The numeral 27 designates guide bars each of which is formed in its bottom surface with right and left recesses 27*a*. A positioning roller 12*e* is secured on the frame 12*a* and urged into pressure contact with the bottom surface of the guide bar 27. The positioning roller 12*e* comes into engagement with the right recess 27*a* when the frame 12*a* reaches its right most position. This condition is detected by a right end sensor 12*h*. The positioning roller 12*e* comes into engagement with the left recess 27*a* when the frame 12*a* reaches its left most position. This condition is detected by a left end sensor 12*i*. The tapered guide members 12*c* come into abutment against the respective protrusions 25*a* to push the corresponding levers 25 upward when the frame 12*a* moves to the left as viewed in FIG. 1.

The document retainer 4 is carried on a support member having push shafts 4*a* mounted thereon for upward and downward movement. The push shafts 4*a* carry a roller holder 4*b* having push rollers 4*c* arranged in parallel-spaced relation. Constant force springs 4*d* are provided to urge the respective push shafts 4*a* for permitting the push rollers 4*c* to come into pressure contact with the center portion of the book placed on the document table 1. The roller holder 4*b* has protrusions 4*e* extending outward in the opposite directions. The protrusions 4*e* are associated with two levers 25, 25' respectively. As best shown in FIG. 2, the lever 25 is pivoted at one end to one of the side plates of the housing 17 for pushing one of the protrusions 4*e* upward at the other end of the lever 25. The lever 25 has a protrusion 25*a* formed intermediate its end. The other lever 25' is pivoted at one end to the other side plate of the housing 17 for pushing the other protrusion 4*e* upward at the other end of the lever 25'. The lever 25' has a protrusion 25*a'* formed intermediate its ends. One of the push shafts 4*a* has a sensor plate 4f secured at the top end thereof. The sensor plate 4f is intended to couple with a position sensor 23.

The page turning apparatus also includes two base members 9 each of which is mounted for sliding movement on a pair of slanted guide rods 10a mounted in spaced parallel relation to each other on the support member (FIG. 2). A feed screw 10b, connected to a motor 10c, extends longitudinally toward a point on which the center of the document to be read is placed on the document table 1. The feed screw 10b is in mesh engagement with a nut 1Od having a cross bar 10e secured thereon. The cross bar 10e, which extends in a direction perpendicular to the feed screw 10b, has two arms, the first arm engaging between guide rollers 9f secured on one of the base members 9, the second arm engaging between guide rollers 9f secured on the other base member 9.

When the motor 10c rotates the feed screw 10b, the cross bar 10e moves leftward or rightward (as viewed in the figures) to move the base members 9 toward or away from the center point. It is to be noted that the guide rods 10a for one of the base members 9 are inclined in a clockwise direction at an angle, for example, of 34. with respect to the feed screw 10b and the guide rods 10a for the other base member 9 are inclined in a counter-clockwise direction at an angle, for example, of 34° with respect to the feed screw 10b so that the base members 9 can move along hypothetical lines extending diagonally with respect to the document. This is effective to place the base members 9 at appropriate locations according to the size of the document.

The appropriate locations can be detected by position sensors 24 mounted on a guide rod 29 extending in parallel with one pair of the guide rods 10a. The position sensors 24 are associated with a sensor plate secured on the corresponding one of the base members 9. Each of the base members 9 carries a page squeezing section 5, a page attracting section 8 (FIG. 3), and a microswitch 22.

Figure 3:
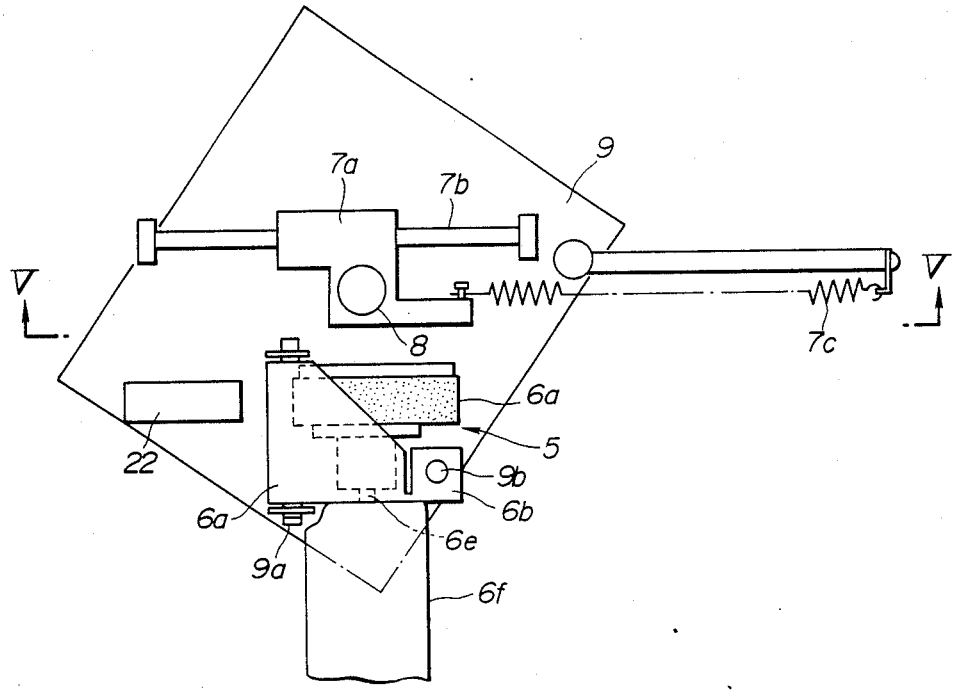
FIG. 3 is an enlarged plan view of the page squeezing and attracting sections included in the page turning apparatus.
Figure 4:
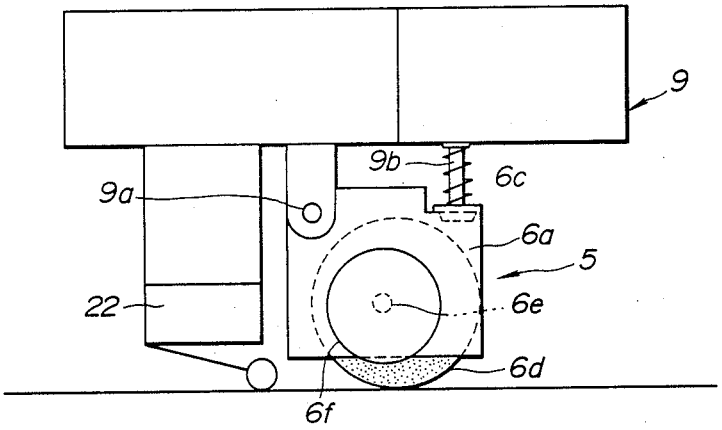
FIG. 4 is an enlarged side view showing the page squeezing section.
Figure 5:
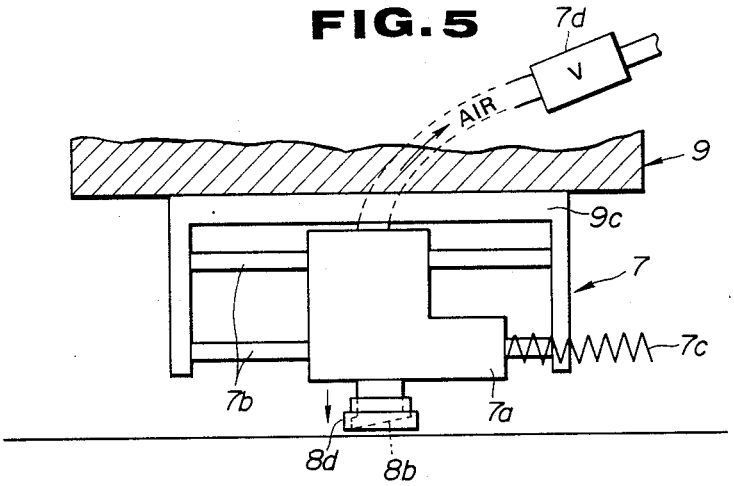
FIG. 5 is an enlarged sectional view taken along the line V—V of FIG. 3.

As best shown in FIGS. 3 and 4, the page squeezing section 5 includes a support frame 6a mounted on bottom of the base member 9. The support frame 6a is mounted for rotation at one side about a horizontal shaft 9a which extends between downwardly extending lugs of the base member 9. At the side of the support frame 6a opposite to the shaft 9a, the support frame has a vertically extending hole 6b in which a downwardly extending shaft 9b is loosely inserted. The shaft 9b is secured at one end to the base member 9 and terminated at the other end thereof in an enlarged head so that the support frame 6a can rotate about the shaft 9a within a limited angular range. A coil spring 6c is placed around the shaft 9b to urge the support frame 6a in the clockwise direct as viewed in FIG. 4. An eccentric friction wheel 6d is mounted for rotation about a horizontally extending eccentric shaft 6e secured to the support frame 6a. The friction wheel 6d has a peripheral surface made of a material such as rubber or the like having a high coefficient of friction. The microswitch 22 is mounted on the base member 9 and positioned for detecting when the document comes into contact with the peripheral surface of the friction wheel 6d.

As best shown in FIGS. 3, 5, 6A and 6B, the page attracting section 7 includes a carrier 7a mounted for sliding movement on a pair of horizontally extending guide rods 7b secured through a mounting member 9c on the base member 9. The mounting member 9c has two arms between which guide rods 7b extend. The arms constitute the left and right limits of movement of the carrier 7a. A spring 7c is provided between the carrier 7a and the base member 9 to urge the carrier 7a toward the right most position as viewed in FIG. 5. The carrier 7a carries an air pipe 8 secured thereon in an upright position.

Figure 6A:
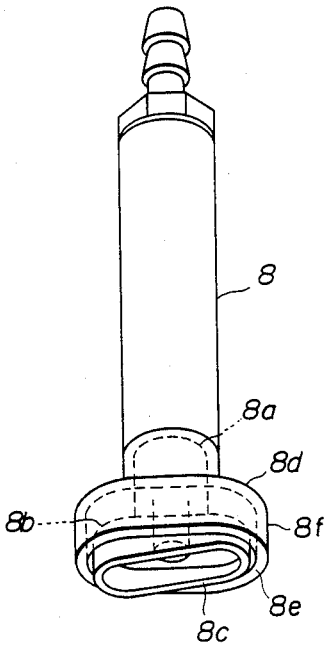
FIGS. 6A and 6B are enlarged perspective views showing two positions between which the outer suction tube is movable.
Figure 6B:
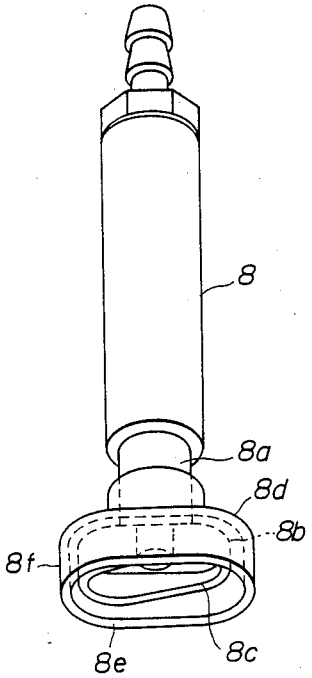
Figure 7A:
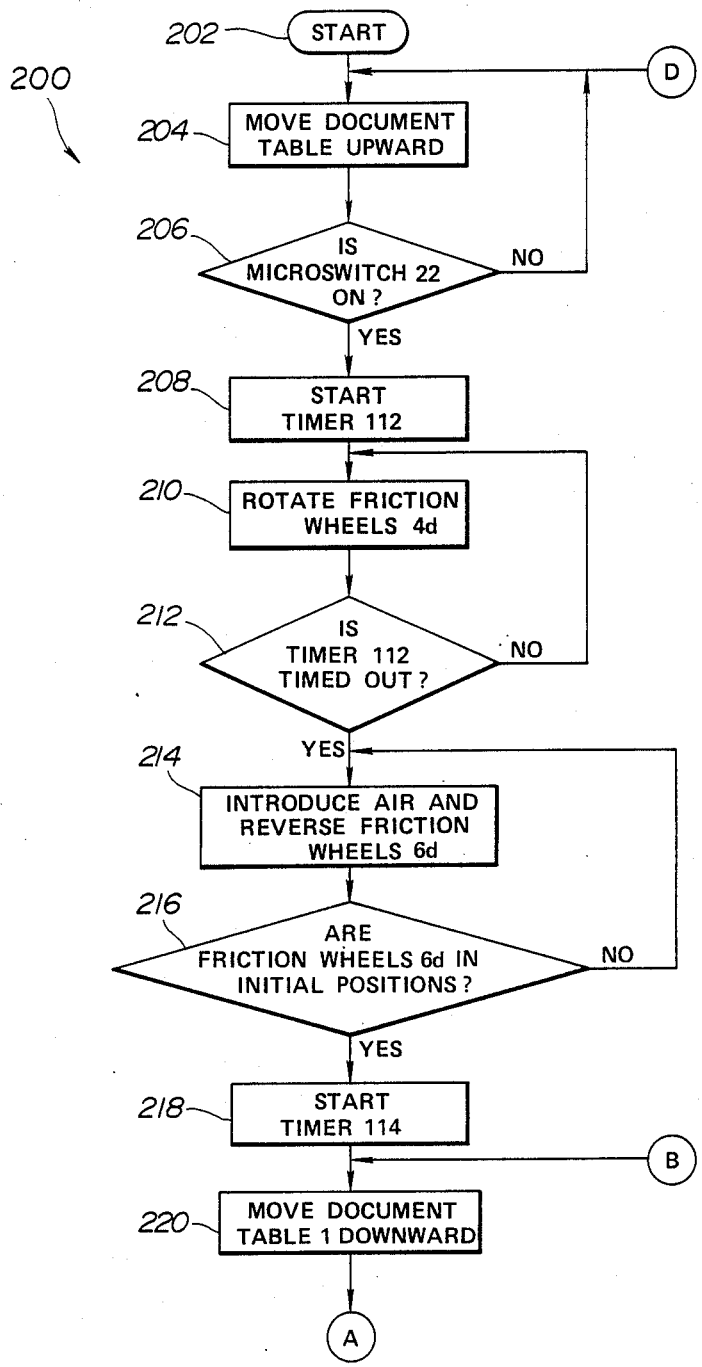
FIGS. 7A to 7E illustrate a flow diagram showing the programming of the digital computer as it is used to control the page turning apparatus.
Figure 7B:
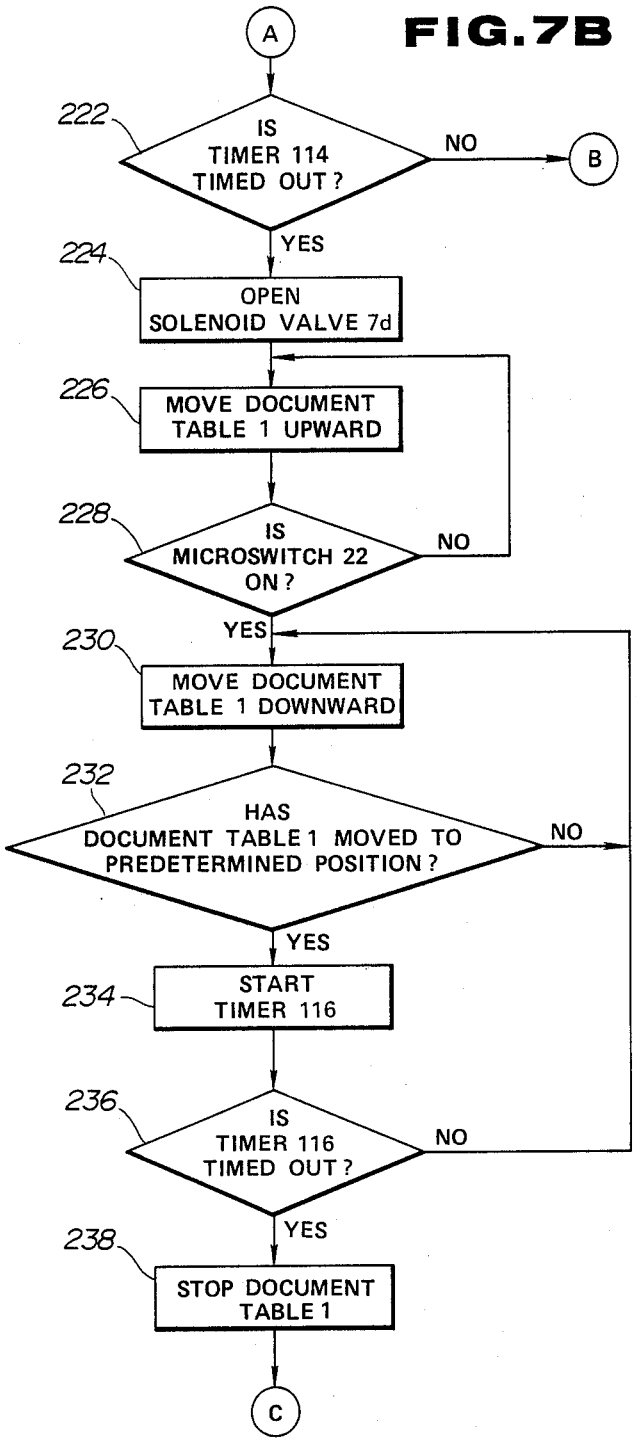
Figure 7C:
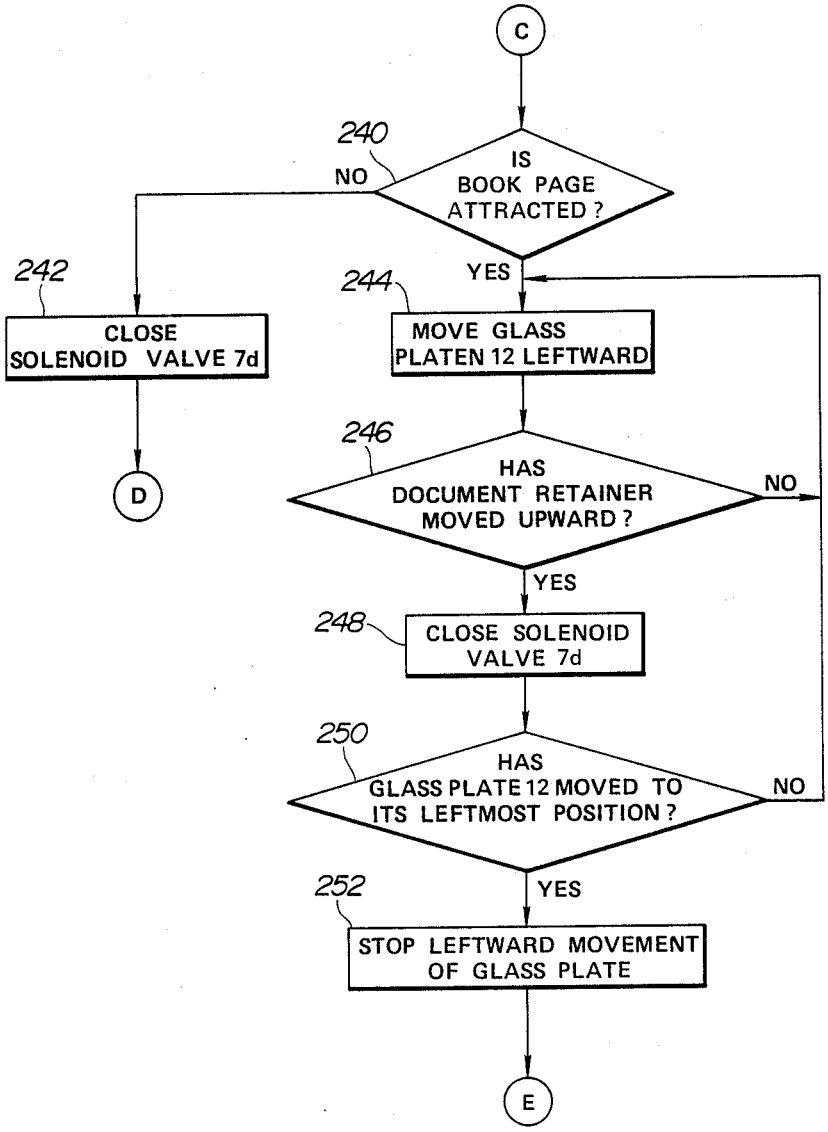
Figure 7D:
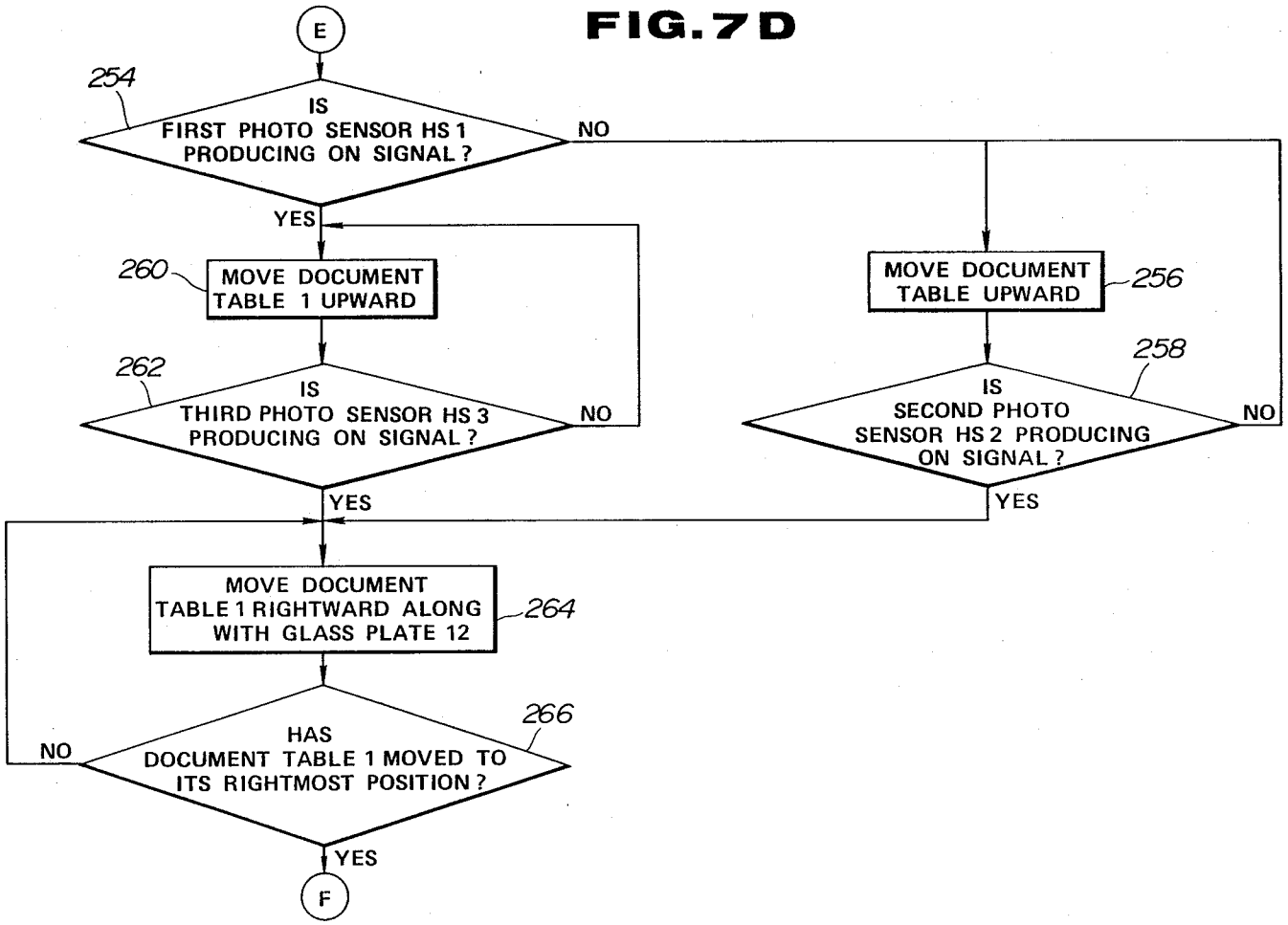
Figure 7E:
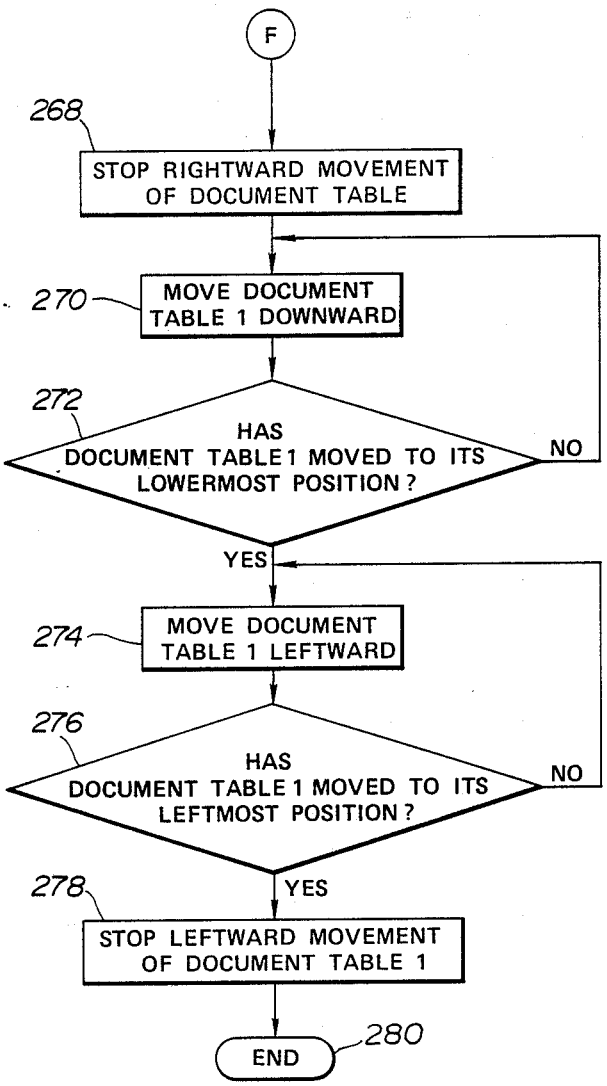

The air pipe 8 is adapted at its top end for connection to an air pump (not shown) through a solenoid valve 7d. The air pipe 8 has a small-diameter end portion 8a terminating at its lower end in a flaring inner suction tube 8b. The inner suction tube 8b has an end surface 8c which is inclined at an angle with respect a horizontal plane. An outer suction tube 8d surrounds the periphery of the inner suction tube 8b. The outer suction tube 8d has a horizontal end surface 8e. The outer suction tube 8d has a collar 8f which circumscribes the lower end portion 8a for sliding movement thereon between first and second positions. At the first position, the collar 8f is in abutment with the shoulder of the air tube 8, as shown in FIG. 6A and the inner suction tube 8b projects from the outer suction tube 8d so that its inclined end surface is lower than the horizontal end surface 8e of the outer suction tube 8d. At the second position where the outer suction tube 8d is in abutment with the shoulder of the inner suction tube 8b, as shown in FIG. 6B, the inner suction tube 8b is placed within the outer suction tube 8d.

Figure 14:
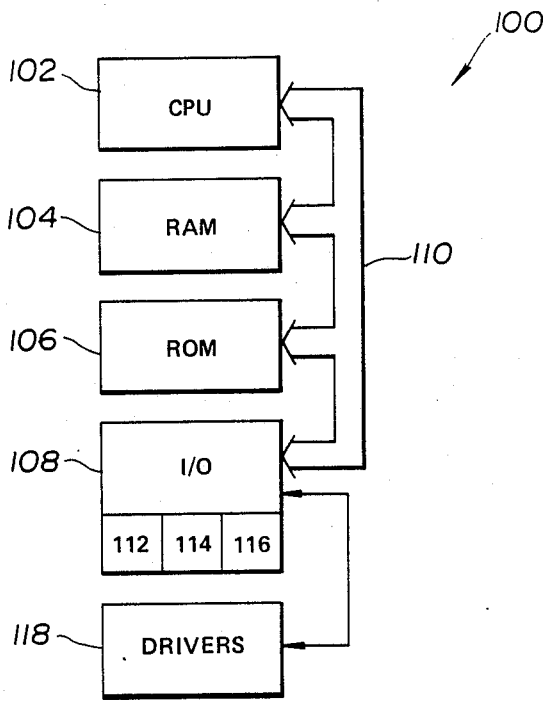
FIG. 14 is a block diagram of the controller of the page turning apparatus.

As shown in FIG. 14, the page turning apparatus includes a control unit 100 for controlling the operation of the page turning apparatus. The control unit 100 comprises a digital computer which includes a central processing unit (CPU) 102, a random access memory (RAM) 104, a read only memory (ROM) 106, and an input/output control unit (I/O) 108. The central processing unit communicates with the rest of the computer via a data bus 110. The input/output control unit includes first, second and third timers 112, 114, 116, respectively, used in controlling the page turning apparatus. The read only memory 106 contains the program for operating the central processing unit 102. Various commands are transferred by the central processing unit to control circuits included in the input/output control unit 108. Drivers connected to the I/O unit 108 convert the transferred commands into control signals for driving the solenoid valve 7d of the air pipe 8 and the motors 6f, 10c, 11d, 14 and 20 in a predetermined sequence.

FIGS. 7A–7E make up a flow diagram illustrating the programming of the digital computer 100 as it is used to control the page turning apparatus.

Figures 8A, 8B, 8C, 8D, 8E, 8F, 8G, 8H, 8I, 8J, 8K:
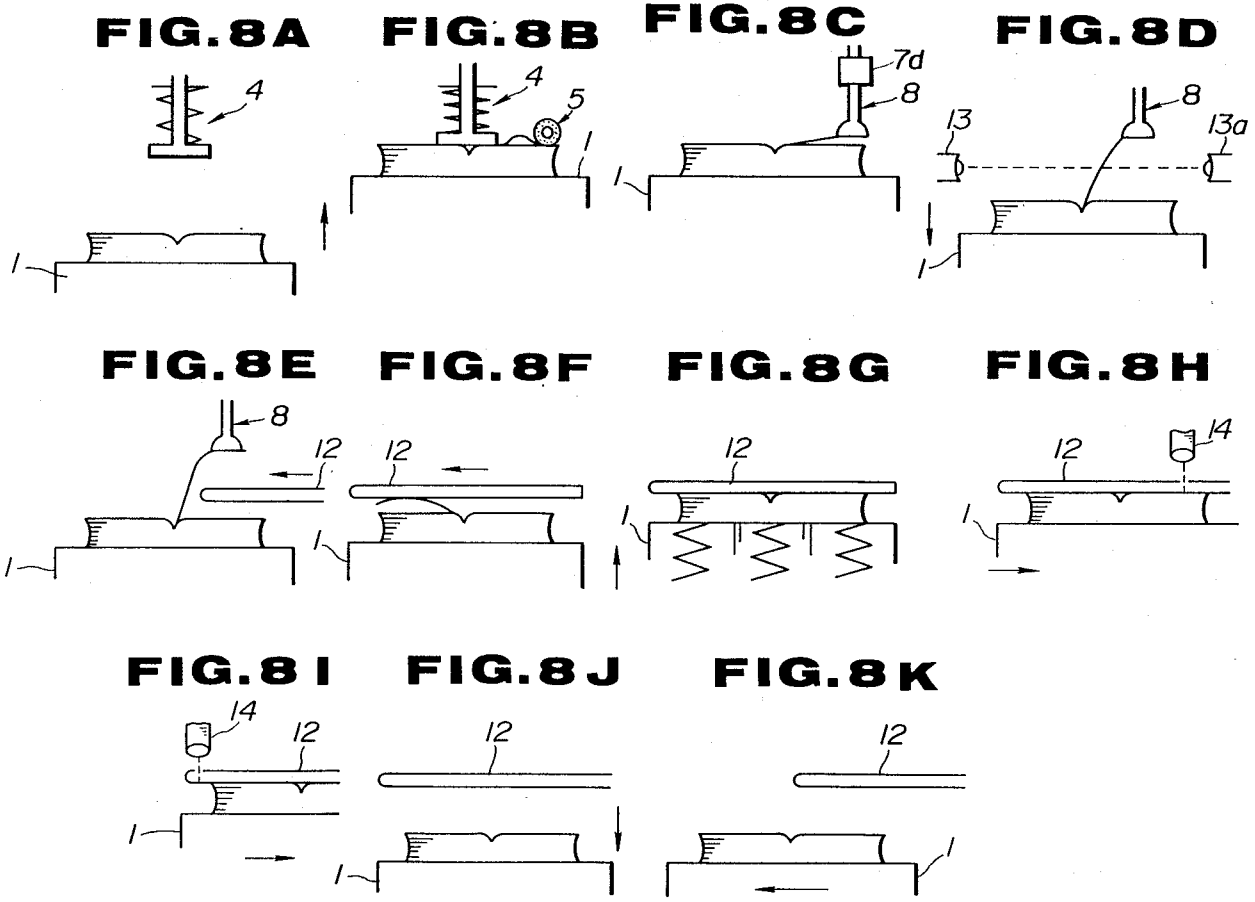
FIGS. 8A to 8K are side views used in explaining the sequence of operations of the page turning apparatus.

The computer program 200 is entered at the point 202 in the program after a book to be read is placed on the document table 1, as shown as FIG. 8A. At the point 204 in the program, the CPU 102 moves the document table 1 upward by operating the drive motor 15 to move the elevating table 2a upward. At the point 206 in the program, a determination is made as to whether or not the microswitches 22 are turned on. If the answer to this question is "no," then it means that the friction wheels 6d are not in contact with the book and the CPU 102 returns to step 204 and moves the document table 1 upward by operating the drive motor 15 to move the elevating table 2a upward. This operation is repeated until the book comes into contact with the friction wheels 6d.

If the answer to the question at step 206 is "yes", then it means that the book has moved upward to the first position where the friction wheels 6d are in contact with the book and the program proceeds to the point 208. At the first position, the book is retained by the document retainer 4, as shown in FIG. 8B. At the step 208, the central processing unit starts the first timer 112 included in the digital computer 100. The first timer 112 has a predetermined time value, for example, 0.5 seconds set therein. At the step 210, the drive motors **6*f* are driven to rotate the friction wheels 6*d* in the clockwise direction, as viewed in the FIG. 8B. Following this, the program proceeds to another determination step at the step 212. This determination is as to whether or not the first timer 112 is timed out. If the answer to this question is "no," then the program returns to the step 210. This operation is repeated until the first timer 112 is timed out. If the answer to the question is "yes," it means that the friction wheels 6*d* have rotated for the predetermined time to squeeze the uppermost page of the book as shown in FIG. 8B and the program proceeds to the step 214**.

At step 214, the drive motors **6*f* are reversed to return the friction wheels 6*d*** toward their initial positions. In doing so, the previously squeezed top page returns to its previous position to overlay the next page, however now air has been introduced into the space between the squeezed page and the next page.

At the step 216, a determination is made as to whether or not the friction wheels **6*d* have returned to their initial positions. This determination is made based on the signals fed from angular sensors to the digital computer. If the answer to this question is "no," then the program proceeds to the step 214. This operation is repeated until the friction wheels 6*d*** returns to their initial positions.

If the answer to the question is "yes," then the central processing unit starts the second timer 114 included in the digital computer 100. The second timer 114 has a predetermined time value, for example, 0.5 seconds set therein. At the step 220, the CPU 102 moves the document table 1 downward by reversing the drive motor 15 to move the elevating table **2*b* downward. At the step 222, a determination is made as to whether or not the second timer 114 is timed out. If the answer to this question is "no," then the program returns to the step 220. This operation is repeated until the second timer 114 is timed out. If the answer to this question is "yes," then it means that the book has moved a slight distance away from the friction wheels 6*d* and the program proceeds to the step 224**. This operation is effective to form an air layer between the uppermost page and the next page.

At the step 244 in the program, the CPU 102 opens the solenoid valve **7*d* to introduce a negative pressure into the air pipe 8. At the step 226, the CPU 102 moves the document table 1 upward by operating the drive motor 15 to move the elevating table 2*b* upward. Following this, the program proceeds to a determination step at the step 228. This determination is as to whether or not the microswitch 22 is turned on. If the answer to this question is "no," then the program returns to the step 226. This operation is repeated until the microswitch 22 is turned on. If the microswitch 22 is turned on, then the program proceeds to the step 230. During these steps, the sucker 8 attracts the uppermost page of the book, as shown in FIG. 8C**.

At the step 230 in the program, the CPU 102 moves the document table 1 downward by reversing the drive motor 15 to move the elevating table **2*b* downward. The document retainer 4 moves downward with the downward movement of the document table 1. At the step 232, a determination is made as to whether or not the document retainer 4 has moved downward to a predetermined position. This determination is made based on a signal fed from the position sensor 23 to the I/O control unit 108. If the answer to this question is "no," then it means that the document retainer 4 is above the predetermined position, the program return to the step 230. This operation is repeated until the document retainer 4 reaches the predetermined position. If the document retainer 4 reaches the predetermined position, the program proceeds to the step 234 where the central processing unit starts the third timer 116 included in the digital computer 100. The third timer 116 has a predetermined time value, for example, 0.2 seconds set therein. Following this, the program proceeds to a determination step at the step 236. This determination is as to whether or not the third timer 116 is timed out. If the answer to this question is "no," then the program returns to the step 230. If the third timer 116 is timed out, then the program proceeds to the step 238 where the CPU 102 stops the document table 1**.

At the step 240 in the program, a determination is made as to whether or not the uppermost book page is attracted. The determination is made based on a signal from the photo sensor 13 to the I/O control unit 108, as shown in FIG. 8D. If the answer to this question is "no," then the program proceeds to the step 242 where the solenoid valve **7*d* is closed to terminate the page attracting operation and thereafter the program returns to the step 204** to begin the page turning program all over again.

If, on the other hand, it is assured that the uppermost book page is attracted, the program proceeds to the step 244 where the CPU 102 operates the gear motor **11*d* to move the glass plate 12 leftward so as to insert its front end below the uppermost book page, as shown in FIG. 8E. The document retainer 4 moves upward in synchronism with the leftward movement of the glass plate 12 toward a predetermined position away from the path of movement of the glass plate due to the engagement of the tapered guide members 12*c* with the protrusions 25*a* on the levers 25. At the step 246, a determination is made as to whether or not the document retainer 4 has moved upward to the predetermined position. This determination is made based on a signal fed from the position sensor 23 to the I/O control unit 108. If the answer to this question is "no," then the program returns to the step 244. This operation is repeated until the document retainer 4** moves to the predetermined position.

If the document retainer 4 has moved to the predetermined position, then the program proceeds to the step 248 where the solenoid valve **7*d* is closed to terminate the page attracting operation. At the step 250, a determination is made as to whether or not the glass plate 12 has reached its left most position. This determination is made based on a signal from the left end sensor 12*i* to the I/O control unit 108. If the answer to this question is "no," then the program returns to the step 244. Otherwise, the program proceeds to the step 252 where the CPU 102 stops the leftward movement of the glass plate 12**.

At the step 254, a determination is made as to whether or not the first photo sensor HS1 is turned on. If the answer to this question is "no," then it means that the book is relatively light and the program proceeds to the step 256 where the CPU 102 moves the document table 1 upward to bring the book into pressure contact with the glass plate 12, as shown in FIG. 8G. At the step 258, a determination is made as to whether or not the second photo sensor HS2 is turned on. If the answer to this question is "no," then it means that the pressure under which the book is in contact with the glass plate 12 is less than a first predetermined value and the program returns to the step 256. This operation is repeated until the second photo sensor HS2 is turned on. If the second photo sensor HS2 is turned on, then the program proceeds to the step 264.

However, if the answer to the question inputted at the step 254 is "yes," then it means that the book is relatively heavy and the program proceeds to the step 260 where the CPU 102 moves the document table 1 upward to bring the book into pressure contact with the glass plate 12, as shown in FIG. 8G. At the step 262, a determination is made as to whether or not the third photo sensor HS3 is turned on. If the answer to this question is "no," then it means that the pressure under which the book is in contact with the glass plate 12 is less than a second predetermined value which is greater than the first predetermined value and the program returns to the step 260. This operation is repeated until the third photo sensor HS3 is turned on. If the third photo sensor HS3 is turned on, then the program proceeds to the step 264.

At the step 264 in the program, the CPU 102 operates the gear motor 20, with the clutch 19 being connected, to move the document table 1 rightward together with the glass plate 12. For this purpose, the frame 12*a* on which the glass plate 12 is secured is locked to the document table 1 before the rightward movement of the document table 1. During the rightward movement of the document table 1, a scanner 14, for example the scanner of an optical character reader, scans the uppermost book pate, as shown in FIGS. 8H and 8I. At the step 266, a determination is made based of whether the on a signal from the right end sensor 12*h* to the I/O control unit 108. If the answer to this question is "no," then the program returns to the step 264. This operation is repeated until the right end sensor 12*h* is turned on. Otherwise, the program proceeds to the step 268 where the CPU 102 stops the rightward movement of the document table 1 by releasing the clutch 19 and stopping the gear motor 20.

Following this, the program proceeds to the step 270 where the CPU 102 moves the document table 1 downward, as shown in FIG. 8J. At the step 272, a determination is made as to whether or not the document table 1 has moved downward to its lowermost position. This determination is made based on a signal fed from the bottom sensor BS to the I/O control unit 108. If the answer to this question is "no," then the program returns to the step 270. This operation is repeated until the bottom sensor BS produces an "on" signal to the I/O control unit 108. If the bottom sensor BS is turned on, then the program proceeds to the step 274 where the CPU 102 moves the document table 1 leftward, as shown in FIG. 8K, by reversing the gear motor 20 with the clutch 19 being connected. At the step 276, a determination is made as to whether or not the document table 1 has moved to its left most position. This determination is made based on a signal fed from the left end sensor 12*i* to the I/O control unit 108. If the answer to this question is "no", then the program returns to the step 274. This operation is repeated until a left end sensor 12*i* is turned on. If the document table 1 reaches the left most position, the program proceeds to the step 278 where the CPU 102 stops the document table 1 by releasing the clutch 19 and stopping the gear motor 20. Following this, the program proceeds to the end step 280.

Figure 9A:
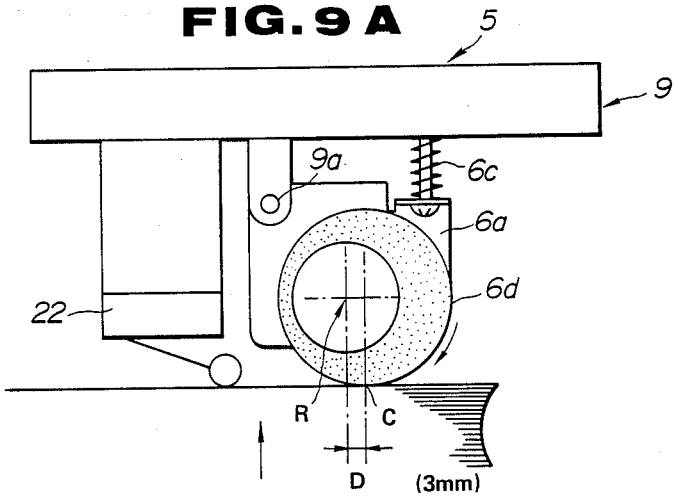
FIGS. 9A to 9C are side views used in explaining the sequence of operations of the page squeezing section.
Figure 9B:
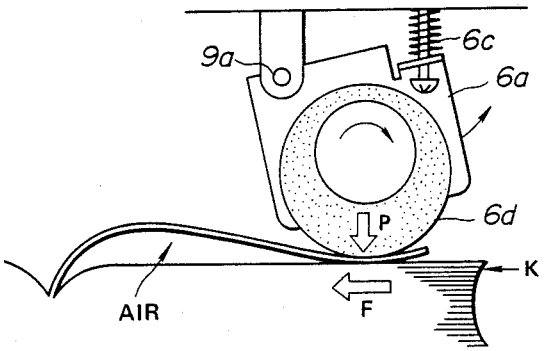
Figure 9C:
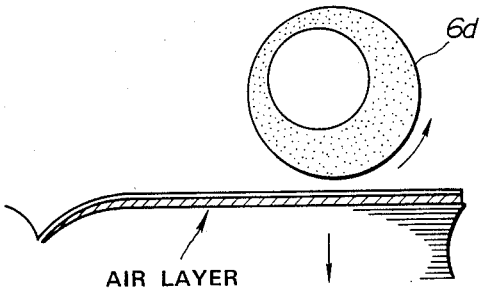

Referring to FIGS. 9A, 9B, and 9C, the operation of the page squeezing section 5 will be described in greater detail. When the document table 1 moves upward to bring the book into contact with the friction wheel 6*d*, as shown in FIG. 9A, the microswitch 22 is turned on, causing the CPU 102 to stop the upward movement of the document table 1 while at the same time rotating the friction wheel 6*d* in the clockwise direction, as viewed in FIG. 9A. The friction wheel 6*d* has a center spaced a distance (D), for example, 3 mm away from the eccentric shaft 6*e*. The distance between the point (C) at which the friction wheel 6*d* is in contact with the uppermost book page and the point (R) about which the friction wheel 6*d* rotates causes an increase in the pressure (P) under which the friction wheel 6*e* is in contact with the uppermost book page as the friction wheel 6*d* rotates in the clockwise direction, as shown in FIG. 9B. When the force (F) of the friction between the friction wheel 6*d* and the uppermost book page, which is in direct proportion to the contract pressure (P), increases to overcome the force of friction between the uppermost book page and the next book page, the uppermost book page is buckled, as shown in FIG. 9B. During the clockwise rotation of the friction wheel 6*d*, the frame 6*a* rotates in the counter-clockwise direction, as viewed in FIG. 9B, about the shaft 9*a* against the resilient force of the coil spring 6*c*. This is effective to limit the friction wheel 6*e* to rotating through a predetermined angle while in contact with the page. When the direction of rotation is reversed at process step 214, the friction wheel 6*d* rotates in the counterclockwise direction, as viewed in FIG. 9C, toward its initial position while at the same time the document table 1 moves down a small distance. During this operation, the buckled book page returns toward its initial condition due to its rigidity and partially traps a layer of air between the uppermost book page and the next page, as shown in FIG. 9C.

Figures 10A, 10B, 10C, 10D, 10E, 10F, 10G:
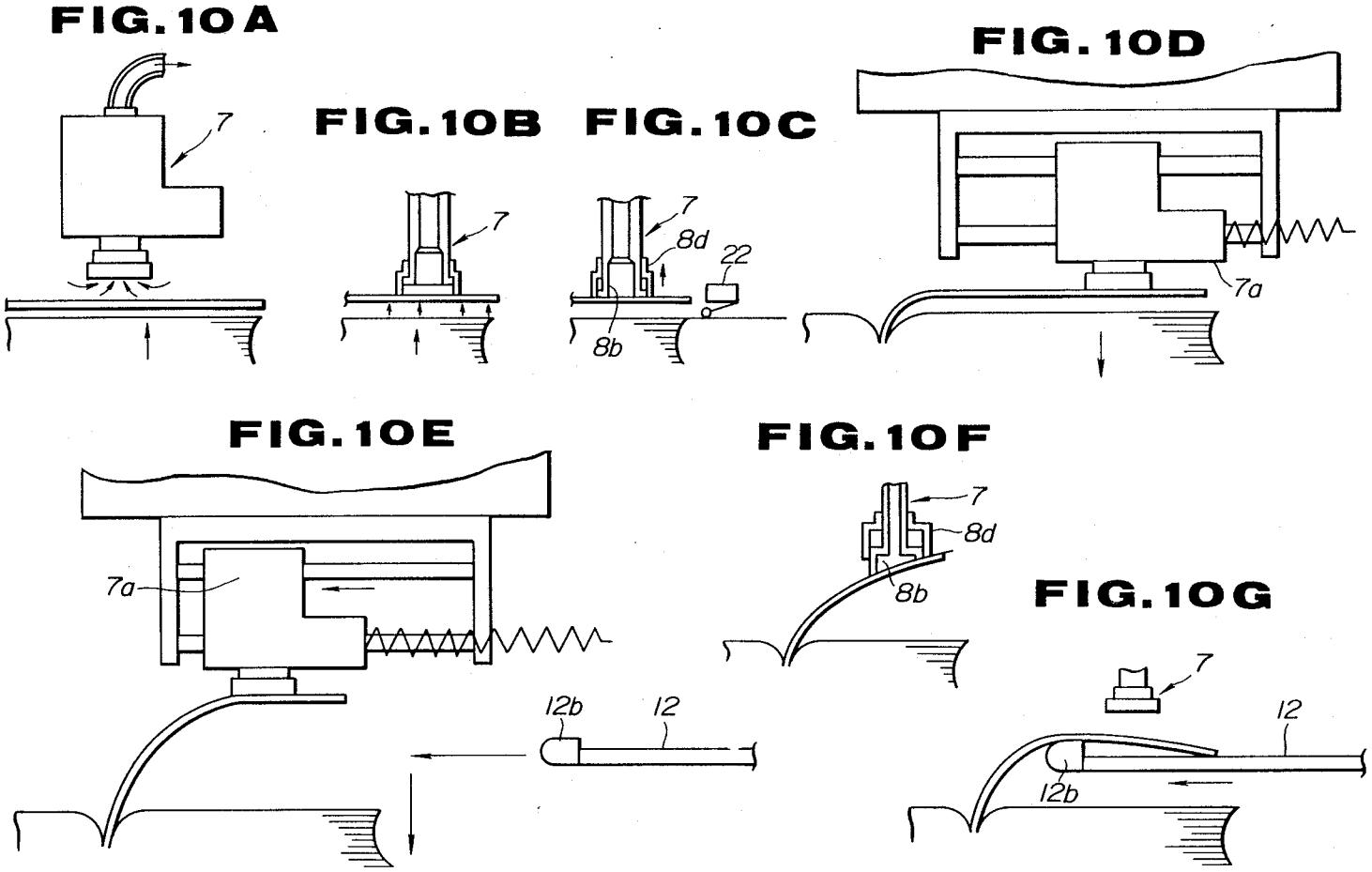
FIGS. 10A to 10G are side views used in explaining the sequence of operations of the page attracting section.

Referring to FIG. 10, the operation of the page attracting section 7 will be described in greater detail. Upon termination of the page squeezing operation, the CPU 102 moves the document table 1 upward again and opens the solenoid valve 7*d* to permit the outer suction tube 8*d* to attract the uppermost book page, as shown in FIGS. 10A and 10B. It is to be noted that two or more book pages would be attracted without the page squeezing operation prior to the page attracting operation. Since the outer suction tube 8*d*, which has a large open end, can provide a great suction force, a small air pump may be used. Because an air layer separates the uppermost book page from the next book page, it is assured that the outer suction tube 8*d* can attract only one book page.

When the document table 1 moves upward to the initial position where the microswitch 22 is turned on, the CPU 102 stops the upward movement of the document table 1, as shown in FIG. 10C. When the outer suction tube 8*d* has its open end closed by the attracted uppermost book page, the suction tube 8*d* slides along the inner suction tube 8*b* due to an increased negative pressure in the air pipe 8 so that the inner suction tube 8*b* can attract the uppermost book page, as shown in FIG. 10F. This is effective to overcome any tendency of air to escape through a space between the attracted book page and the suction tube when the attracted book page curves.

Under this condition, the document table 1 is moved downward, as shown in FIG. 10D. This causes the attracted uppermost book page to pull the carrier 7*a* along the guide rods 7*b* against the resilient force of the spring 7*c*. At the same time, the glass plate 12 moves leftward, as shown in FIG. 10E. When the round front end 12*b* comes below the attracted book page, as shown in FIG. 10G, the solenoid valve 7*d* is closed to terminate the page attracting operation of the page attracting section 7. Thereafter, the glass plate 12 continues to move leftward to turn the uppermost book page. In this embodiment where the end surface 8*c* of the inner suction tube 8*b* is inclined at an angle ranging from about 10° to about 20° with respect to a horizontal plane, it is found that the page attracting section 7 has an ability to attract a B6-sized page having a 150 μm thickness.

Figure 11A:
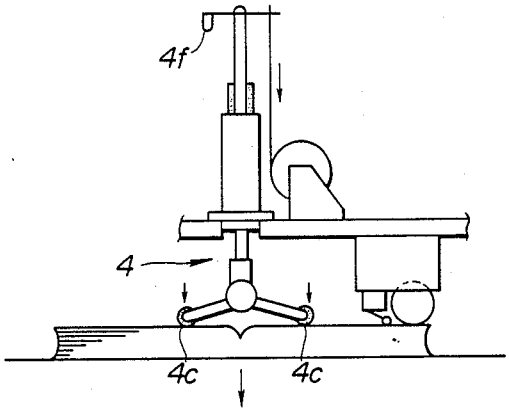
FIGS. 11A to 11C are side views used in explaining the sequence of operations of the document retainer.
Figure 11B:
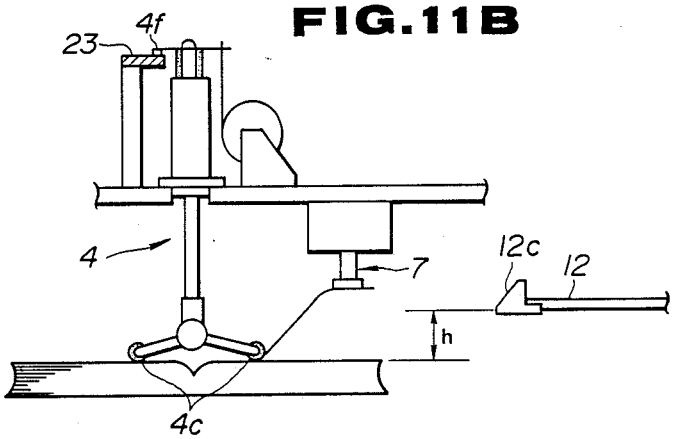
Figure 11C:
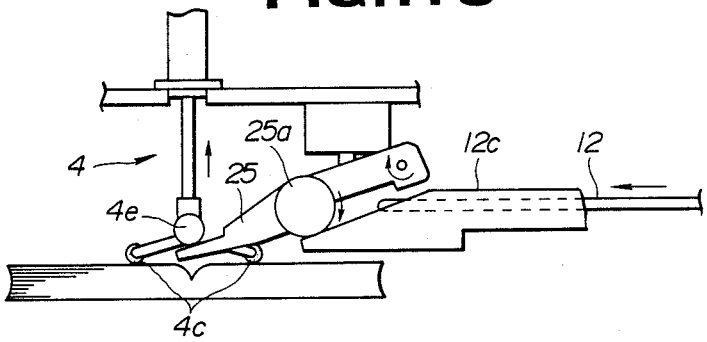

Referring to FIG. 11, the book retaining operation of the document retainer 4 will be described in greater detail. When the document table 1 moves upward to the position where the microswitch 22 is turned on, the constant force springs 4*d* resist upward movement of the document retainer 4 as it contacts the book, causing the push rollers 4*c* to push the center portion of the book under a constant force so as to spread the open book pages, as shown in FIG. 11A. When the uppermost book page is attracted, as shown in FIG. 11B, the document table 1 moves downward along with the document retainer 4. When the document table 1 moves downward to a predetermined position, the position sensor 23 detects this position, causing the CPU 102 to stop the downward movement of the document table 1. The position of the photo sensor 23 is such that the book is spaced at a distance (h) away from the glass plate 12 so that the glass plate 12 can move without any interference with the book. With the leftward movement of the glass plate 12, the tapered front ends 12*c* of the frame 12*a* push the protrusions 25*a*, causing the respective levers 25 to push the document retainer 4 upward to a position away from the path of movement of the glass plate 12.

Figure 12A:
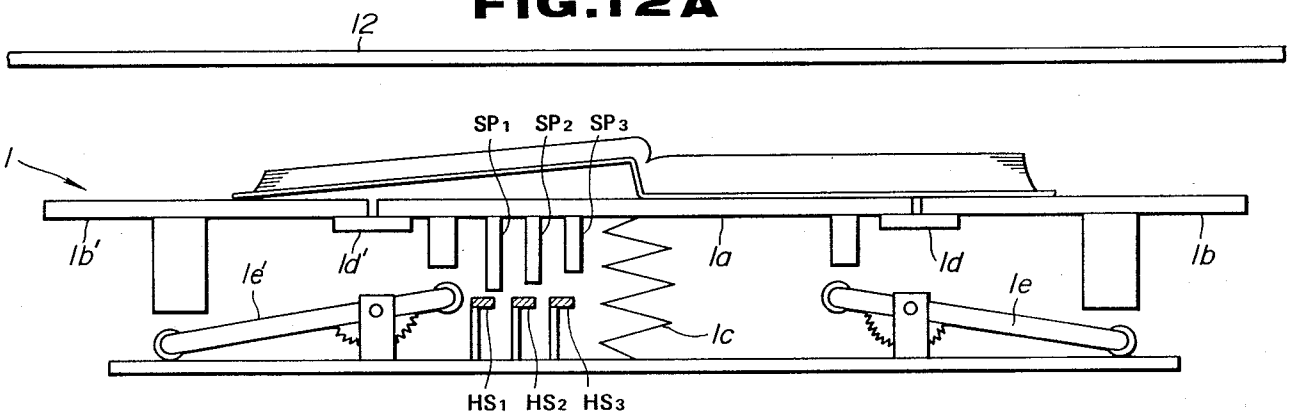
FIGS. 12A and 12B are side views used in explaining the operation of the document table unit.

Referring to FIG. 12, the operation of the document table unit will be described in greater detail. When a thick book is placed on the document table 1 and the book is opened to have thin and thick page portions, as shown in FIG. 12A, the glass plate 12 can only be pressed into contact with the thin page portion with considerable difficulty. According to the invention, this difficulty is overcome by using a document table divided into three portions 1*a*, 1*b* and 1*b*′ supported separately on the elevating table 2*a*.

Figure 12B:
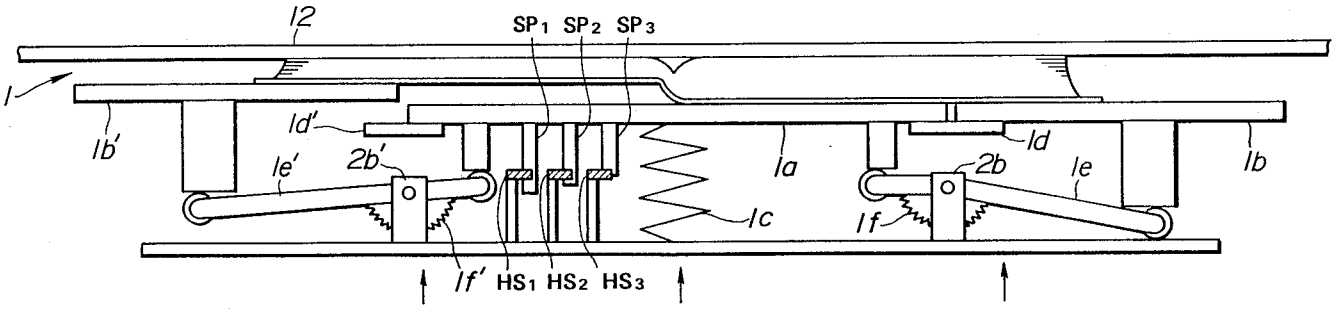

First, the center table 1*a* is moved upward. With the upward movement of the center table 1*a*, the stoppers 1*d* and 1*d*′ move the right and left side tables 1*b* and 1*b*′ upward. When the thick page portion comes into pressure contact with the glass plate 12, the center table 1*a* pushes the left side table 1*b*′ upward through the flexible lever 1*e*′ to bring the thin page portion in pressure contact with the glass plate 12, as shown in FIG. 12B. Under this condition, the center table 1*a* pushes the right side table 1*b* through the flexible lever 1*e*. However, the flexible lever 1*e* deflects to prevent application of any excessive force to the right side table 1*b*.

It was determined empirically that a thicker book requires a greater pressure to place the book in contact with the glass plate 12. The contact pressure is determined by the amount of compression of the springs 1*c* extending between the center table 1*a* and the elevating table 2*a*. A heavy book is determined when the photo sensor HS1 senses the sensor plate SP1. For example, the photo sensor HS1 may be selected to sense the sensor plate SP1 when the book has a weight greater than 1kg. If the photo sensor HS1 senses the sensor plate SP1, the elevating table 2*a* is moved upward until the photo sensor HS2 senses the sensor plate SP3 so that the book is pressed against the glass plate 12 under a greater pressure. Otherwise, the elevating table 2*a* is moved upward until the photo sensor SP2 senses the photo plate SP2 so that the book is pressed against the glass plate 12 under a smaller pressure.

Figure 13A:
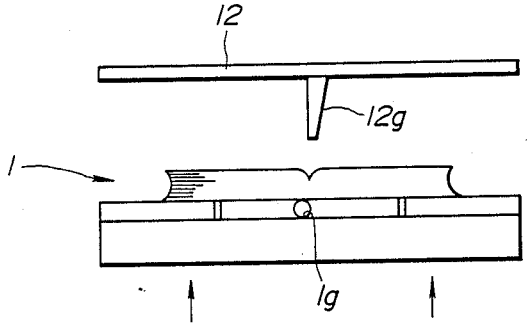
FIGS. 13A and 13B are side views used in explaining the manner of engaging the glass plate with the document table.
Figure 13B:
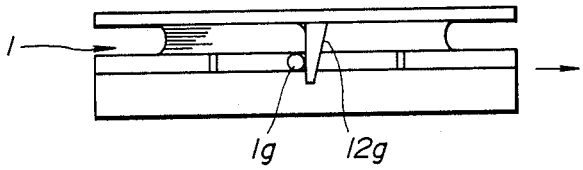

The frame 12*a* on which the glass plate 12 is placed has stoppers 12*g* provided on the opposite sides thereof, as shown in FIG. 13A. When the book comes into pressure contact with the glass plate 12, the stoppers 12*g* come into engagement with respective lock pins 1g provided on the opposite sides of the center table 1*a* so that the glass plate 12 can move along with the document table 1 to the right, as viewed in FIG. 13B, for the scanning operation.

While this invention has been described in conjunction with a specific embodiment thereof, it is evident that many alternatives, modifications and variations will be apparent to those skilled in the art. Accordingly, it is intended to embrace all alternative, modifications and variations that fall within the scope of the appended claims.

What is claimed is:

1. A method of mechanically turning the pages of a bound volume placed face up on a document table, comprising the steps of:

mechanically applying a frictional force to the uppermost one of the pages in a direction toward the center of the book to buckle the uppermost page and thereby permit air to enter a space between the buckled page and the next page;

disengaging the frictional force from uppermost page to permit the uppermost page to return toward its initial position due to its rigidity so as to form an air layer between the uppermost page and the next page;

mechanically applying an attracting force to the uppermost page in an upward direction so as to lift the uppermost page off of the underlying page; and moving an engaging member along a path crossing the attracted uppermost page to turn the uppermost page.

2. An apparatus for mechanically turning the pages of a bound volume placed face up on a document table, comprising:

means for mechanically applying a frictional force to the uppermost one of the pages in a direction toward the center of the book to buckle the uppermost page and thereby permit air to enter a space between the buckled page and the next page;

means for disengaging the frictional force from uppermost page to permit the uppermost page to return toward its initial position due to its rigidity so as to form an air layer between the uppermost page and the next page;

means for mechanically applying an attracting force to the uppermost page in an upward direction so as to lift the uppermost page off of the underlying page; and means for moving an engaging member along a path crossing the attracted uppermost page to turn the uppermost page.

3. A page turning apparatus comprising:

a document table for supporting a bound volume placed face up on the document table, first means including a friction member for rubbing the uppermost one of the pages in a direction toward the binding of the volume to buckle the uppermost page so as to permit air to enter a space between the buckled page and the next page;

second means for releasing the friction member from the uppermost page to permit the uppermost page to return to its initial condition due to its rigidity so as to form an air layer between the uppermost page and the next page;

third means for generating a negative pressure against the uppermost page to attract the uppermost page upward;

fourth means including a plate movable along a travelling path crossing the attracted page to turn the uppermost page; and a control unit for operating the first, second, third and fourth means in this sequence.

4. The apparatus as claimed in claim 3, wherein the first means includes a support member, a frame mounted on the support member, and the friction member comprises a friction wheel mounted on the frame for rotation about an eccentric axis, and wherein the control unit includes means for rotating the friction wheel in a first direction from an initial position to buckle the uppermost page, wherein the second means comprises means for determining when the friction wheel has rotated a predetermined angle from the initial position and outputting a signal indicative of that fact, and means responsive to this signal for rotating the friction wheel in a second, reversed direction to the initial position.

5. The apparatus as claimed in claim 4, further comprising means for mounting the frame on the support member for movement with respect to the support member and to adjust the friction force to be substantially constant.

6. The apparatus as claimed in claim 3, wherein the third means includes an air pipe for connection to an external source of suction, the air pipe terminating in a flared inner suction tube having an end surface positioned in a plane inclined with respect to a horizontal plane, and an outer suction tube mounted for sliding movement around the inner suction tube, the outer suction tube having a horizontal end surface.

7. The apparatus as claimed in claim 3, wherein the document table is divided into a center table and first and second side tables located on the opposite sides of the center table, center table support means for supporting the center table for movement toward and away from the document table while urging the center table resiliently away from the support means, side table support means mounted on the center table support means for moving the first and second side tables, independently of each other, toward and away from the document table, the center table having stoppers secured thereon for holding the center table at the same level as the lowest of the first or second side tables when they move downward with respect to the center table.

8. The apparatus as claimed in claim 7, wherein the side table support means comprise a first flexible lever pivotally mounted on the center table support means, the first flexible lever having one end for pushing the first side table upward when the center table pushes the other end of the first flexible lever downward, and a second flexible lever pivotally mounted on the center table support means, the second flexible lever having one end for pushing the second side table upward when the center table pushes the other end of the second flexible lever downward.

9. An apparatus for turning pages of a bound volume having a spine and which is opened to have first and second stacks of pages on the opposite sides of the spine, the first stack having turned pages, the second stack having pages to be turned, the apparatus comprising:

a document table for supporting the volume;

squeezing means located at a position opposite to the uppermost page of the second stack for squeezing the uppermost page to provide a small space between the uppermost page and the remaining pages of the second stack;

attracting means located at a position opposite to the uppermost page of the second stack for attracting the uppermost page to increase the space between the uppermost page and the remaining pages of the second stack;

coupling means for mechanically coupling together both the squeezing means and the attracting means for simultaneous sliding movement over the second stack; and turning means for turning the attracted uppermost page over the spine onto the first stack.

10. The apparatus as claimed in claim 9, wherein the squeezing means includes roller means movable into contact with the uppermost page of the second stack, the roller means being driven to rotate for moving the uppermost page toward the spine.

11. The apparatus as claimed in claim 9, wherein the attracting means includes an air nozzle for sucking the squeezed uppermost page.

12. The apparatus as claimed in claim 9, wherein the coupling means comprises a plate carrying both of the squeezing means and the attracting means for sliding movement over the second stack.

13. The apparatus as claimed in claim 9, wherein the coupling means comprises first and second slidable plates which are spaced apart from each other and each carrying both of the squeezing means and the attracting means for sliding movement over the second stack.

14. The apparatus as claimed in claim 13, which comprises means for moving the first and second plates simultaneously to vary the distance between the first and second plates according to the size of the book or document pages.

15. The apparatus as claimed in claim 9, wherein the turning means includes a transparent glass plate movable along a path crossing the attracted uppermost page to turn the uppermost page over the spine onto the first stack.

16. The apparatus as claimed in claim 15, which further comprises retaining means provided for movement into pressure contact with the first and second stacks for retaining the first and second stacks, and means for moving the retaining means away from the first and second stacks when said glass plate moves along the path crossing the attracted uppermost page.

* * * * *